US011089895B2

(12) United States Patent
Meckle et al.

(10) Patent No.: US 11,089,895 B2
(45) Date of Patent: Aug. 17, 2021

(54) FOLDABLE TRAY

(71) Applicant: CleanTab GmbH, Grosselfingen (DE)

(72) Inventors: Ralf Meckle, Gomaringen (DE); Tobias Hahn, Grosselfingen (DE); Mirko Roman Tochtermann, Tuebingen (DE)

(73) Assignee: CleanTab GmbH, Grosselfingen (DE)

( * ) Notice: Subject to any disclaimer, the term of this patent is extended or adjusted under 35 U.S.C. 154(b) by 151 days.

(21) Appl. No.: 16/441,496

(22) Filed: Jun. 14, 2019

(65) Prior Publication Data

US 2019/0380401 A1 Dec. 19, 2019

(30) Foreign Application Priority Data

Jun. 15, 2018 (DE) ..... 102018114469.5

(51) Int. Cl.
*A47G 23/06* (2006.01)
*A41D 13/04* (2006.01)

(52) U.S. Cl.
CPC ..... *A47G 23/06* (2013.01); *A41D 13/04* (2013.01); *A41D 2300/32* (2013.01); *A41D 2400/42* (2013.01)

(58) Field of Classification Search
CPC ... A47G 23/0608; A47G 23/06; A47B 23/041
USPC ..... 108/43, 165, 44
See application file for complete search history.

(56) References Cited

U.S. PATENT DOCUMENTS 106,016 A * 8/1870 Woodbury ..... A47B 23/002 108/43
126,213 A * 4/1872 Ireland et al. ..... A47B 23/002 108/43
151,090 A * 5/1874 Chapman ..... A47B 23/002 108/27
297,219 A * 4/1884 Anthony ..... A47B 23/002 108/43

(Continued)

FOREIGN PATENT DOCUMENTS

DE 20 2013 104 398 U1 10/2013
FR 2 900 556 A1 11/2007

(Continued)

OTHER PUBLICATIONS

German Examination Report in DE 10 2018 114 469.5, dated May 10, 2019, with English translation of relevant parts.

*Primary Examiner* — Jose V Chen
(74) *Attorney, Agent, or Firm* — Collard & Roe, P.C.

(57) ABSTRACT

In the state of the art, numerous trays are known, so as to protect clothing from crumbs or droplets that fall down when eating a meal during a car ride or train ride. It is true that these trays catch everything, as desired, but for the remainder they are quite impractical, since the open tray with the droplets or crumbs stands in the car or train and must be cleaned before being stowed away or is actually only available as a disposable solution. Other solutions are too large to be conveniently stowed away after use.
For this reason, a foldable tray is proposed, which can be folded up in sealed manner after use, into a compact unit, (Continued)

without the crumbs or droplets being able to exit from the unit. This is possible by means of division of a base plate having a connected apron, wherein the base plate consists of two parts that can be folded up, between which the apron can be laid.

7 Claims, 1 Drawing Sheet

(56) References Cited

U.S. PATENT DOCUMENTS 322,942 A * 7/1885 Lance ..... A47B 23/002 108/43
696,044 A * 3/1902 Hoffmann ..... A47B 23/002 108/43
1,336,954 A * 4/1920 Angus ..... A47B 3/04 108/43
1,462,471 A * 7/1923 Alpiner ..... A63F 1/10 273/309
1,851,600 A * 3/1932 Stanley ..... A47B 23/041 108/43
3,125,825 A * 3/1964 Gaudette ..... A47B 23/002 248/444
3,172,636 A * 3/1965 Collier ..... A47B 23/00 248/444
5,106,156 A * 4/1992 Marquis ..... B60N 3/002 108/43
5,209,370 A 5/1993 Pickett et al.
5,221,032 A * 6/1993 Bott ..... A45F 5/00 108/43
5,285,940 A * 2/1994 Goulter ..... A45F 5/00 108/43
5,429,057 A * 7/1995 Buescher ..... A47B 23/002 108/43
5,558,026 A * 9/1996 Seibert ..... B60N 3/005 108/44
5,642,674 A 7/1997 Joye, Sr. et al.
5,671,479 A 9/1997 Dedrick
5,845,585 A * 12/1998 Meeus ..... B60N 3/005 108/44
6,243,869 B1 * 6/2001 Ekovich ..... A41B 13/10 2/46
7,363,865 B2 * 4/2008 Rubenstein ..... B60N 3/005 108/165
7,806,305 B1 * 10/2010 Moore, Jr. ..... A45F 5/00 224/265
8,091,486 B1 * 1/2012 Broaddrick ..... A47G 23/0633 108/43
8,794,162 B2 * 8/2014 Hisata ..... B64D 11/0638 108/43
2003/0230220 A1 * 12/2003 Evans ..... A47C 7/70 108/43
2005/0205571 A1 * 9/2005 Carpenter ..... A47G 23/06 220/6
2006/0237518 A1 * 10/2006 Hageneder ..... B42D 9/00 229/67.1
2007/0119348 A1 * 5/2007 Evans ..... B60N 3/002 108/44
2010/0236452 A1 * 9/2010 Ruddy ..... B43L 3/008 108/6
2017/0265632 A1 9/2017 Johnson

FOREIGN PATENT DOCUMENTS

WO 2005/000693 A1 1/2005
WO WO-2013167816 A1 * 11/2013 ..... A45F 3/14

* cited by examiner

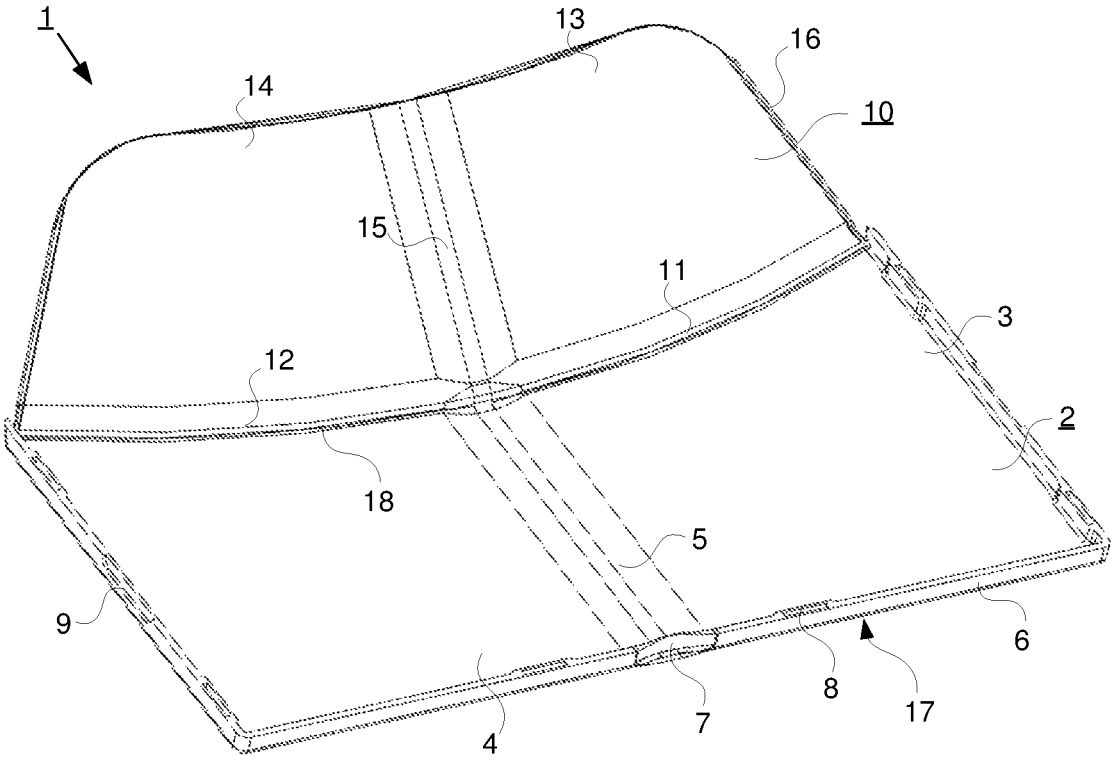
1
13
16
14
10
15
11
3
12
2
18
5
9
6
8
17
7
4

FOLDABLE TRAY

CROSS REFERENCE TO RELATED APPLICATIONS

Applicant claims priority under 35 U.S.C. § 119 of German Application No. 10 2018 114 469.5 filed on Jun. 15, 2018, the disclosure of which is incorporated by reference.

The present invention relates to a foldable tray, comprising a base plate that is delimited by a circumference edge along its outer edges, has an apron that can be laid against the base plate, which apron is connected with the base plate along an abdomen edge of the latter.

Such trays are already known from the state of the art. For example, WO 2005/000693 A1 provides a tray having a base plate, which tray possesses a hinge element in its edge region, within the circumference edge. An apron in the form of a one-piece or multi-piece plastic panel can be clipped into this hinge element, which apron can be leaned against the upper body of the user and catches crumbs or droplets that fall down or at least guides them onto the tray, into the interior of the circumference edge.

U.S. Pat. No. 5,209,370 A offers a similar solution, in which, however, an apron is connected with the circumference edge itself, in articulated manner, so that this apron can be set upright during use or leaned against the upper body of the user. Here, too, a circumference edge delimits the surface of the tray all around, as is usual in the case of trays, and prevents crumbs and the like from falling off the tray.

It is true that these solutions catch crumbs and droplets in satisfactory manner, but after use they must be cleaned so that they can be put away. The user therefore has to think about where the crumbs can be disposed of and might have to find a waste container to empty his/her tray there. If liquids have run out on the tray, it also has to be wiped off so that it can be put away. In contrast, if the user leaves the tray standing in the vehicle, there is the risk, until cleaning occurs, that the content of the tray will be accidentally emptied in the vehicle.

In comparison, the object of FR 2 900 556 A1 is significantly less compact and is structured in the manner of a vendor's tray. The user hangs a sort of bib around his/her neck, on which bib a box is attached. Securing straps hold the overall construction in position. After use, the bib can be laid over the opening of the box and thereby close it off.

In any case, in this way cleaning of the tray can wait until the end of the trip, but the tray is extremely impractical in terms of handling during the entire trip, because it takes up a lot of room.

A similar solution, but structured as a disposable tray, is known from DE 20 2013 104 398 U1. There, a bib having a tray is folded up from a paper sheet, and disposed of after use.

A very compact tray having a connected apron is known from U.S. Pat. No. 5,671,479 A. This tray is produced from a flexible material, which can be folded together after use by means of rotation of a stiff edge element. However, this brings with it the result that here, too, the tray must already have been freed of crumbs before it is folded together, since otherwise, crumbs lying on the tray can fall off during folding.

Against this background, the present invention is based on the task of proposing a foldable tray that overcomes the disadvantages of the state of the art and is compact, and is also able to stow the tray away in the non-cleaned state, without having to fear that crumbs will fall off.

This is accomplished by means of a foldable tray in accordance with the characteristics of the independent claim. Further practical embodiments of such a foldable tray can be derived from the subsequent dependent claims.

According to the invention, it is provided that a foldable tray, as in the state of the art, has a base plate, which is delimited by a circumferential edge. In contrast to the state of the art, however, the base plate is produced from multiple plate parts that are connected with one another in articulated manner, which parts are preferably formed with mirror symmetry along a joint axis. These parts, as soon as they are folded together relative to one another, form a cavity into which an apron connected with the base plate can be laid and in which it can be completely accommodated.

In this way, it is possible to fold the apron down onto the tray after use of the foldable tray, and subsequently or simultaneously to fold the two plate parts of the base plate, which are connected with one another in articulated manner, together like a book, with the effect that the apron, with the crumbs and droplets situated on it, as well as with the content of the tray is packed up and enclosed in the cavity of the folded-up tray. Without already having to clean the tray at this time, it can now be carried along, without having to fear that crumbs will exit from it and scatter.

Such a tray can find use in different situations; in particular, this is practical during trips in a car, in an airplane, but also at rest stops or in fast-food restaurants or at work in an office.

In a concrete embodiment, the articulated connection between the at least two plate parts can be structured as a first film hinge, so that ultimately, the tray more or less has the appearance of a DVD case. Furthermore, a second film hinge can be provided at the contact locations of the circumferential edges, in each instance, so that the circumferential edge is completely circumferential in the unfolded state of the tray, and, at the same time, nevertheless seals off the cavity between the plate parts at the same time, in the folded-up state.

In the region of the abdomen edge, at which the apron can be affixed, the circumferential edge can be left out, so that the connection region of the apron itself forms the circumferential edge. Alternatively, the apron simply starts within the circumferential edge, so that the apron can be completely accommodated in the cavity. Connection of the apron can, once again, take place by way of a third and a fourth film hinge, which are connected, in each instance, with the related plate parts, at their section of the abdomen edge.

First of all, the apron can be formed from the most varied materials. In particular, it should be washable and food-safe. If it consists of a soft material that does not have a stable shape, it can possess reinforcement rails at the edges, so as to prevent it from falling down onto the tray while the user is eating.

Alternatively, however, the apron can be produced from a rigid, although preferably elastic material. Then, however, the apron in turn should be produced from two adjacent apron parts, which are preferably connected with one another by way of a fifth film hinge. In this configuration, it is particularly advantageous to configure the abdomen edge of the base plate to be concave. In this way, the apron that is folded up supports the open position of the plate parts, so that the overall construction becomes more stable. When the apron is folded down, then vice versa, the plate parts are also folded together, and this also additionally secures the closed state.

In the folded-up state, closure of the cavity between the plate parts can be guaranteed in that the circumferential edges fall directly one on top of the other. Alternatively, however, it is also possible to form the circumferential edges with mirror symmetry relative to the articulation joint between the plate parts, so that the circumferential edges do not overlap one another, but rather one edge comes to lie on the other, in congruent manner.

To some advantage, in the folded-up state, reciprocal fixation of the plate parts can also take place in that at the circumferential edges, closure means that lie opposite one another are brought into reciprocal engagement. Magnets, for example, which can be integrated into the circumferential edges, or, alternatively, other closure means such as hooks and eyes, hook-and-loop closures, snap closures, and the like, are suitable for this purpose.

While the folding hinges of the overall construction can reliably prevent crumbs from being able to fall out of the cavity between the plate parts, it is significantly more difficult to produce a tight seal for liquids. For this reason, instead of a fluid-tight outer wall, a nonwoven cloth can also be provided on the inner sides of the plate part, which cloth absorbs liquids directly and thereby prevents liquid from exiting from the cavity between the plate parts. Such a nonwoven cloth can be releasably connected with the base plate, in this regard, for example by way of a hook-and-loop tape, adhesive strip or also by way of insertion tabs, clamping element or bracing elements.

In an advantageous further development of the folding hinges, spring elements can be assigned to them, which elements can hold the plate parts in a defined position. These elements can be implemented in the form of mono-stable or bi-stable springs, the latter in such a manner that they possess an unstable point of equilibrium. In this way, the tray is held in place in an end position in an unfolded state, just like in a folded-up state.

Since the apron can have only a restricted size due to the requirement that it must fit into the cavity between the plate parts, the invention provides for optionally assigning additional connection elements to the apron, with which elements an additional bib can be connected with the apron. These can be any kind of connection means, as long as the bib has the correspondingly counter-acting elements assigned to it. In particular, magnetic connectors or hook-and-loop connectors, with which a connection between bib and apron can be implemented so as to seal off the transitions, are suitable for this purpose.

The invention described above will be explained in greater detail hereinafter, using an exemplary embodiment. FIG. 1 shows a foldable tray in an unfolded state, in this regard, in a perspective representation at a slant from above.

FIG. 1 shows a foldable tray 1, which is essentially produced from a base plate 2 and an apron 10. The base plate 2 is surrounded, at three outer edges 17, by a circumferential edge 6, so that to keep crumbs or food residues falling onto the tray 1 on the tray 1 and to prevent them from dropping off due to a slanted position of the tray 1.

The outer edges 17 are cut straight, to a great extent, with the exception of the outer edge that faces the user during intended use, the abdomen edge 18. This is cut to be concave, so that the tray 1 can also be placed close to the body on the lap of the user. Furthermore, along the abdomen edge 18 the circumferential edge 6 is also left out, and an apron 10 is assigned to the base plate 2, which apron can be folded onto the base plate 2 and represents a shield in front of the upper body of the user in the unfolded state.

In the center of the base plate 2, a first film hinge 5 is provided, which connects a first plate part 3 of the base plate 2 with a second plate part 4 of the base plate 2. Connection takes place in such a flexible manner that the first plate part 3 can be folded over, in the end position, parallel to the second plate part 4, until the plate parts 3 and 4 come to lie one on top of the other, enclosing a cavity between them.

The apron 10 is also divided, accordingly, into a first apron part 13 and a second apron part 14, and consists of an elastic but rigid material. Nevertheless, the apron parts 13 and 14 have reinforcement rails 16 at their edges, which are supposed to impart more stability to the free edges of the apron 10. Third and fourth film hinges 11 and 12 are disposed between the apron parts 13 and 14 and the plate parts 3 and 4, so that the apron 10 can be folded down onto the base plate 2. Due to the concave shape of the abdomen edge 18, the base plate will also fold together along the first film hinge when the apron 10 is folded down onto the base plate 2, and the apron 10 will also do so along a fifth film hinge 15 disposed between the apron parts 13 and 14. When the fifth film hinge 15 and the first film hinge 5 finally lie directly one on top of the other, then due to the cut, the tray 1 has already been folded up, to a great extent.

In this regard, the apron 10, instead of the circumferential edge 6 left out along the abdomen edge 18, prevents crumbs from falling out of the folded-up tray 1. At the contact location between the circumferential edges 6 of the individual plate parts 3 and 4, a second film hinge 7 is provided, which also seals off these contact locations. This film hinge simply curves inward, and the circumferential edges 6 subsequently seal this region off automatically.

In the folded-up state, finally, the circumferential edges 6 of both plate parts 3 and 4 lie congruently on one another and are fixed in place on one another using magnetic closures 8 distributed over the circumferential edges 6. The folded-up tray 1 is similar in appearance to a DVD case, and encloses the apron 10 as well as crumbs or food residues that have fallen onto the tray 1 in itself. In this way, it can be pocketed again after the meal, and can be cleaned at another opportunity. It can then be opened again by way of a handle depression 9. Furthermore, a nonwoven cloth can be releasably disposed on the surface of the base plate 2, which cloth can also reliably absorb any liquid that occurs and prevent it from dripping out of the folded-up tray 1.

What has been described above is therefore a foldable tray, which can alternated between an unfolded state, ready for use, and a folded-up, compact closed state, wherein in the closed state, crumbs and food residues that have fallen onto the tray remain enclosed until the tray is cleaned at the next opportunity. Unsafe transport of the dirty tray is avoided, as is unwieldy transport, so that it is unnecessary to do without reliability or convenience.

REFERENCE SYMBOL LIST

1 tray
2 base plate
3 first plate part
4 second plate part
5 first film hinge
6 circumferential edge
7 second film hinge
8 magnetic closures
9 handle depression
10 apron
11 third film hinge
12 fourth film hinge
13 first apron part
14 second apron part
15 fifth film hinge

16 reinforcement rail
17 outer edge
18 abdomen edge

The invention claimed is:

1. A foldable tray comprising a base plate, which is delimited, along its outer edges, by a circumferential edge, has an apron that can be laid against the base plate, which is connected with the base plate along an abdomen edge of the latter, wherein the base plate is produced from first and second plate parts, which are connected with one another in articulated manner, in such a manner that the first plate part can be folded over the second plate part with the apron enclosed between the first and second plate parts, wherein the circumferential edge is interrupted in the region of the abdomen edge, and the apron is connected with the abdomen edge of the base plate by means of at least one film hinge, and wherein the apron comprises a rigid material or reinforcement rails disposed on first and second lateral edges of the apron.

2. The foldable tray according to claim 1, wherein the first and second plate parts are connected with one another by way of at least a first film hinge.

3. The foldable tray according to claim 1, wherein the abutting circumferential edges of the first and second plate parts are connected with one another by means of a circumferential-edge film hinge.

4. The foldable tray according to claim 1, wherein the abdomen edge has a concave shape, and the apron is produced from first and second adjacent apron parts.

5. The foldable tray according to claim 1, wherein in a folded-up state, the circumferential edges of the first and second plate parts that lie on top of one another lie congruently on top of one another.

6. The foldable tray according to claim 5, wherein the circumferential edges have closure means for reciprocal fixation of the first and second plate parts in the folded-up state.

7. The foldable tray according to claim 1, wherein at least one nonwoven cloth is releasably assigned to the inner sides of the first and second plate parts.

* * * * *